US005337003A

United States Patent [19]

Carmichael et al.

[11] Patent Number: 5,337,003

[45] Date of Patent: Aug. 9, 1994

[54] SELF-CONTAINED, CLIP-ON ENGINE OPERATING TIME LOG

[76] Inventors: Edward W. Carmichael, 4373 Sequoyah Rd., Oakland, Calif. 94605; Robert B. Legge, 1465 Kring Way, Los Altos, Calif. 94024

[21] Appl. No.: 997,519

[22] Filed: Dec. 28, 1992

[51] Int. Cl.[5] ..... F02P 17/00; G04F 8/00; G04B 117/00

[52] U.S. Cl. ..... 324/402; 324/149; 324/156

[58] Field of Search ..... 324/126, 133, 384, 402, 324/390–392, 149, 156, 127; 123/116

[56] References Cited

U.S. PATENT DOCUMENTS

| | | | |
|---|---|---|---|
| 2,408,045 | 9/1946 | Cottrell | 324/402 |
| 2,760,157 | 8/1956 | Dexter | 324/95 |
| 3,213,366 | 10/1965 | Eadie, Jr. | 324/127 |
| 3,686,569 | 8/1972 | Neilson | 324/126 |
| 4,052,665 | 10/1977 | Gruenwald | 324/402 |
| 4,090,130 | 5/1978 | Willenbecher, Jr. | 324/402 |
| 4,375,617 | 5/1983 | Schweitzer, Jr. | 324/133 |
| 4,706,016 | 11/1987 | Schweitzer, Jr. | 324/102 |
| 5,001,431 | 3/1991 | Garasimowicz et al. | 324/402 |
| 5,001,432 | 3/1991 | Wixon | 324/384 |
| 5,003,518 | 3/1991 | Felder | 368/110 |
| 5,140,257 | 8/1992 | Davis | 324/127 |
| 5,208,541 | 5/1993 | Yerkovich et al. | 324/402 |

OTHER PUBLICATIONS

Running Time Meter (RTM) by Computime, Inc.

ARM-12 Engine Hour Log by Autonnic Research International, Inc.

*Primary Examiner*—Walter E. Snow

*Assistant Examiner*—Jay M. Patidar

[57] ABSTRACT

A self-contained, clip-on engine operating time log comprises a case containing circuitry for monitoring the accumulated operating time of a spark ignition engine. A plastic sensor, rigidly extending from the case, has two semi-cylindrical channels for clipping the time log directly onto an ignition wire of the engine. The sensor and the circuitry detect spark impulses in the ignition wire for determining the operating time of the engine. A liquid crystal display, visible through a window of the case, digitally displays the accumulated operating time.

16 Claims, 3 Drawing Sheets

SELF-CONTAINED, CLIP-ON ENGINE OPERATING TIME LOG

FIELD OF THE INVENTION

This invention relates generally to engine monitoring devices, specifically to an engine operating time log for monitoring the actual operating time of spark ignition engines.

BACKGROUND OF THE INVENTION

In many applications, the operating times of spark ignition, internal combustion engines need to be accurately monitored. For example, engines used in military inflatable crafts which are stored underwater for covert operations must be strictly maintained every dozen hours. Aircraft engines, whether military or civilian, must also be strictly maintained according to actual operating hours. Rental vehicles, boats, generators, construction equipment, or anything powered by spark ignition engines that are rented hourly all require accurate and reliable accounting of the machines' operating times.

Engine operating time logs, or meters, for monitoring total engine operating time have been available for many years. On older spark ignition engines in which the sparks are generated from a low voltage source such as a battery, the monitoring device is usually an electromechanical hour counter (Hobbs meter) powered by the vehicle's battery. The counter is triggered by the engagement of the ignition system. When the ignition system is turned on, the counter will begin its timing operation; when the ignition is turned off, the counter will cease its timing operation. The elapsed time thus indicates the ignition system's operating time. The elapsed times of each operation are added together to produce the accumulated or total operating time of the engine. Another common type of hour log determines engine operating time by counting the number of spark impulses at a predetermined engine speed. These devices have many drawbacks:

A. Many must be specifically configured, by the user, for the number of cylinders in the engine to be monitored. An improperly configured unit will produce erroneous readings. Because many users do not read instructions, improper configuration often occurs.

B. They require at least a three wire hookup: One wire for attaching to the ignition system, and two for attaching to the vehicle's battery. Because long wires must be routed to several distant locations, they must be laboriously secured along their lengths. Otherwise, they could become tangled in the moving parts of the engine.

C. Because they rely on the vehicle's battery for power, those which use electronic timers will loose their data when the vehicle's battery is disconnected, such as during battery replacement, or during regular engine servicing.

D. Many of these devices monitor the operating time of the engine's ignition system, not the actual running time of the engine itself. Therefore, if the ignition system is turned on without the engine running, they will produce erroneous readings.

E. Those devices which count spark impulses will produce erroneous readings if the engine is not operated constantly at the single, predetermined speed.

F. The Hobbs meter cannot be used on modern, multi-cylinder engines which do not use a spark distributor, but generate spark voltages for each cylinder individually.

G. Many of these device have main housings which must be mounted away from the heat and fuel lines of the engine. This will require very long hookup wires, and complicates installation.

Currently, Autonnic Research International, Inc. in Hayward, Calif., produces a compact engine time log which monitors accumulated engine operating time for spark ignition engines, which hereinafter will be known as the reference device. It is self-contained in a single case, which has an integral metal mounting/grounding tab extending from it for mounting the time log directly onto an electrically grounded engine block. The reference device is the first time log to be self-powered, which eliminates the need for cumbersome power hookup, and maintains the data even when unit is disconnected from the engine. It uses extremely low power CMOS (Complementary-Metal Oxide Semiconductor) components and an extremely long life lithium battery. An insulated lead wire with a capacitive sensor clip at the distal end, or flying sensor clip, extends from the device for attaching to a spark plug wire or ignition wire. Because the self-powered reference device is mounted directly onto the engine, the sensor lead can be very short. The reference device is heat resistant, and is tightly sealed against liquid intrusion and tampering. These features make installation very easy.

The reference device, which senses spark impulses in the ignition wire, will begin counting when pulses begin passing through the ignition wire, and will stop counting when the pulses cease. The elapsed time during which sparks are present represent the engine operating time. The delayed start ensures that the engine is actually running before the timer is activated. A LCD (Liquid Crystal Display) panel on the device shows the total accumulated engine operating time, in tenths of an hour, to 19,999.9 hours. The reference device may be used on any type of spark ignition engine, regardless of the type of ignition system, the number of cylinders, the number of strokes, or engine speed. Therefore, it has no need for adjustments or setup. Because of the design and quality of its components, it has a known operating life which exceeds ten years, and a projected life of twenty years. It also has an accuracy of $\pm 3$ seconds per thousand hours of running time. These superior qualities has enabled the reference device to be adopted by the U. S. Navy. However, because it must be bolted directly onto an engine block, it will require the removal of a bolt from the engine. This will void a commercial engine's warranty.

The Running Time Meter TM made by Computime, Inc. of Denham Springs, La., was introduced after the reference device has become known. It is the only other self-powered time log on the market. However, it has a main housing which must be mounted some distance away from the heat and fuel lines of an engine, which will necessitate routing long lead wires through the engine compartment. Moreover, it has a sensing wire which must be wrapped many turns around an ignition wire, the number of turns being dependent upon the length of the sensing wire, and largely determined by trial-and-error. As a result, installation is cumbersome.

In conclusion, existing engine time logs are either cumbersome to install and setup, susceptible to producing incorrect readings, vulnerable to data loss, or will void the manufacturers' warranty of commercial engines.

SUMMARY OF THE INVENTION

Accordingly, several objects and advantages of the invention are to provide an improved engine time log which is entirely self-contained, which entire unit may be easily and securely installed onto any convenient ignition wire of an engine, which is self-powered, which may be used on hand-start engines lacking battery power, which is compact and light weight, which is invulnerable to data loss during its operating life, which requires only a single wire hookup, which can accurately monitor the actual operating time of an engine, which can accurately monitor engines regardless of their number of cylinders, strokes, or type of ignition system, which does not need to be adjusted by the user, which cannot be readily reset so that readings cannot be falsified, which is heat, liquid, and tamper resistant, which does not affect the operation of the engine, which has a very long operating life, and which is simple and economical to manufacture.

Further objects and advantages will become apparent from a study of the following description and the accompanying drawings.

In a preferred embodiment of the invention, a self-contained, clip-on engine time log comprises a flat, square case which contains electronics and circuitry on a circuit board for monitoring the accumulated operating time of a spark ignition engine. A LCD display shows the total time under a window on the case. A clip-shaped sensor external to the case is structurally and electrically attached to the circuit board through an opening on the bottom surface of the case. The sensor has two parallel, overlapping, semi-cylindrical channels of slightly different diameters, both of which are open to the clip's distal end. Depending on its size, an engine's ignition wire is snapped into one of the channels such that the engine time log is clipped directly onto and supported by the ignition wire. The only wire hookup is a grounding wire extending from the case, which can be attached to any grounded part of the engine compartment. Electrically, the clip-on time log operates in a manner identical to the reference device described in the previous section. Therefore, it possesses all of the advantages of the reference device. Because the clip-on time log is not bolted to the engine block, it can be used on commercial engines without voiding the warranty.

Figure 1:
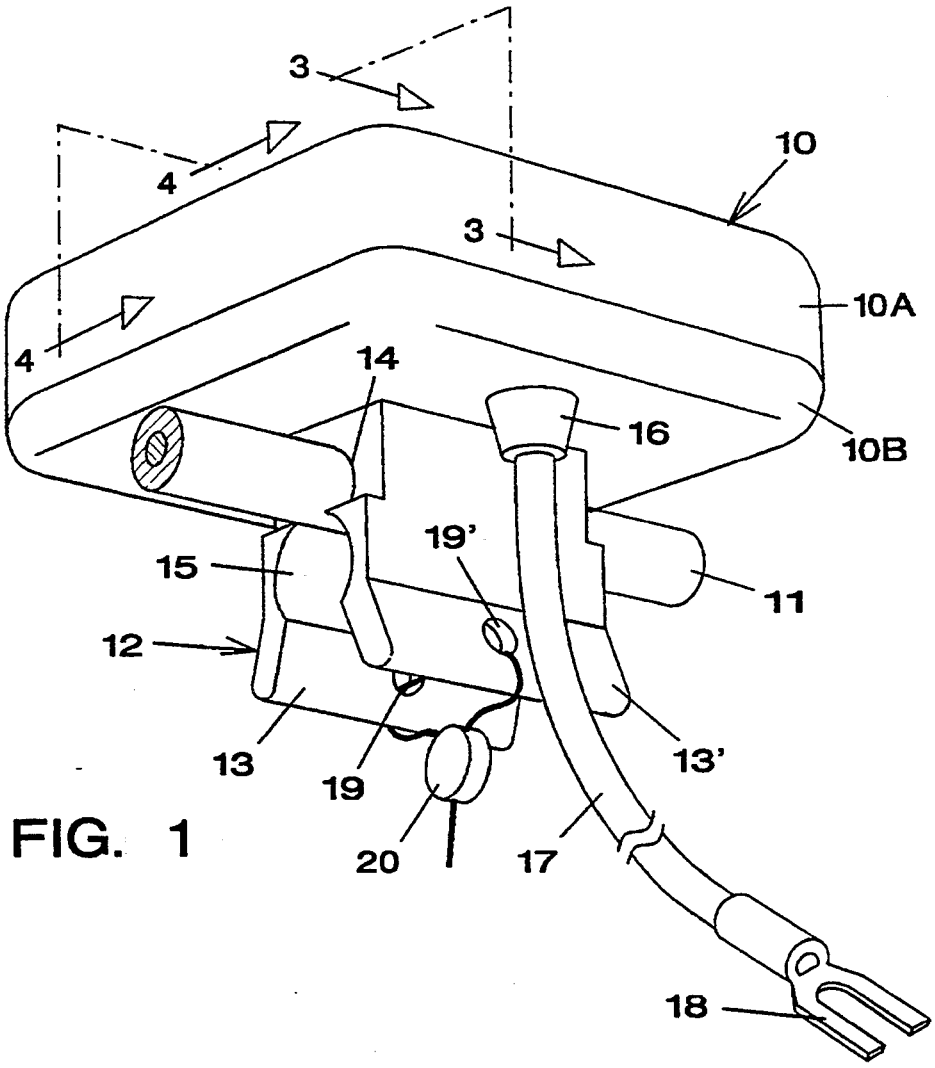
FIG. 1 is a rear perspective view of the self-contained, clip-on engine operating time log in accordance with a preferred embodiment of the invention.
Figure 2:
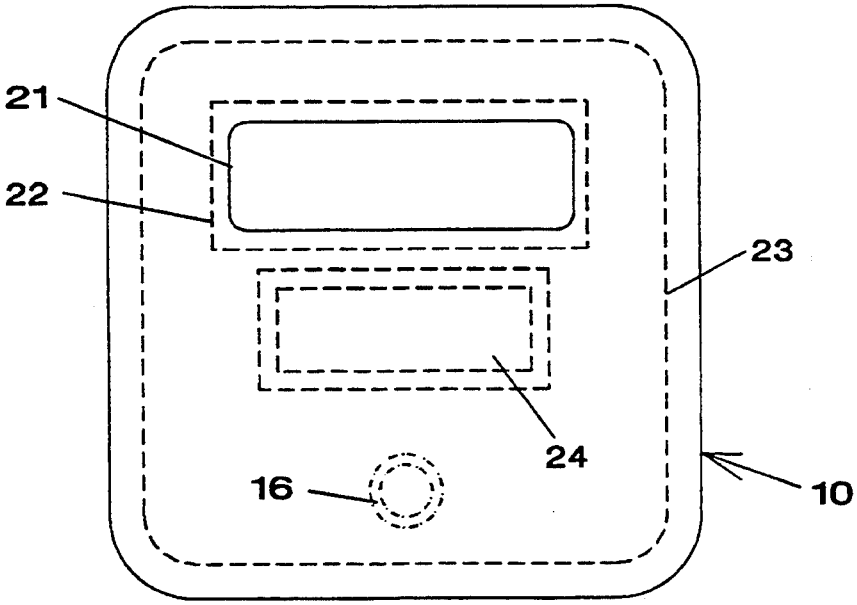
FIG. 2 is a top view of the engine time log of FIG. 1

| Drawing Reference Numerals | |
|---|---|
| 10. Case | 11. Ignition Wire |

-continued

| Drawing Reference Numerals | |
|---|---|
| 12. Sensor | 13. Flange |
| 14. Small Channel | 15. Large Channel |
| 16. Strain Relief | 17. Grounding Wire |
| 18. Grounding Lug | 19. Hole |
| 20. Retaining Wire | 21. Window Opening |
| 22. Bezel | 23. Inside Wall |
| 24. Sensor Opening | 25. Joint |
| 26. Joint | 27. Tube |
| 28. PCB | 29. Shaft |
| 30. Screws | 31. Conductive Trace |
| 32. Shoulder | 33. Circuitry |
| 34. Ignition System | 35. Grounded Portion |

DESCRIPTION—FIG. 1

In accordance with a preferred embodiment of the invention shown in FIG. 1, a self-contained, clip-on engine operating time log comprises a flat, square case 10 attached onto a typical spark plug or ignition wire 11 by an integral sensor 12, which also serves as a mounting clip. Case 10, which comprises a top halve 10A and a bottom halve 10B, contains electronic components and circuitry identical to that used in the reference device described in the "Background Of The Invention" section. Therefore, the engine time log possesses all of the electrical advantages of the reference device. Electrically non-conductive case 10 is made of a heat and solvent resistant polymer such that it can be place anywhere near the engine. It is completely sealed such that it resists liquids and tampering.

Sensor 12 is generally in the shape of an inverted and extruded "U" and has two slightly flared flanges 13 and 13' at its distal end. A small cylindrical channel 14 having a diameter similar to most smaller ignition wires runs through the upper portion of sensor 12, while a large cylindrical channel 15 having a diameter similar to most larger ignition wires runs through the mid portion of the sensor, slightly overlapping small channel 14 such that both channels communicate with the space between flanges 13 and 13'. Being made of a somewhat flexible plastic, sensor 12 can be snapped onto wire 11 easily but securely for holding the entire time log directly on the wire. Ignition or spark plug wires found on most engines exist in a range of sizes; wire 11 shown is on the smaller end of the spectrum. Therefore, small channel 14 can be used for attaching the engine time log onto smaller wires, while large channel 15 can be used for larger wires. In addition to being a mounting device, sensor 12 is also the spark sensor at the front end of the time log's circuitry (not shown), and performs the same electrical function as the flying capacitive sensor clip in the reference device (37 Background" section). Therefore sensor 12 is a capacitive sensor.

A strain relief 16 in the shape of a truncated cone extends from the lower side of bottom halve 10B, adjacent a long side of sensor 12. An insulated grounding wire 17, which is connected to the circuitry (not shown) within case 10 and having a grounding lug 18 at the distal end, extends through strain relief 16. The grounding wire can be connected to any electrically grounded portion of a vehicle or equipment, such as the engine compartment wall, and performs the same electrical function as the metal mounting/grounding tab on the reference device ("Background" section). Two holes 19 and 19' disposed through flanges 13 and 13', respectively, allow a tamper resistant retaining wire 20 or any other type of retainer to be installed. This prevents the engine time log from accidentally falling off wire 11 or being intentionally removed. When the time log is used in rental equipment, retaining wire 20 will act as a deterrence against tampering, or provide positive evidence of tampering if it has been forcibly removed. Alternatively, a conventional cotter pin (not shown) may be used instead when tamper resistance is not needed.

DESCRIPTION—FIG. 2

In this front view of the engine time log, square case 10 has a cutout or window opening 21 under which an LCD panel (not shown) will be located for displaying the cumulative engine operating time. A clear plastic or glass bezel 22 is mounted under window opening 21 with adhesive (not shown) to serve as a protective seal. An inside wall 23 of the case is shown. A rectangular sensor opening 24 is located at the center portion of lower halve 10B (FIG. 1) of case 10.

Figure 3A:
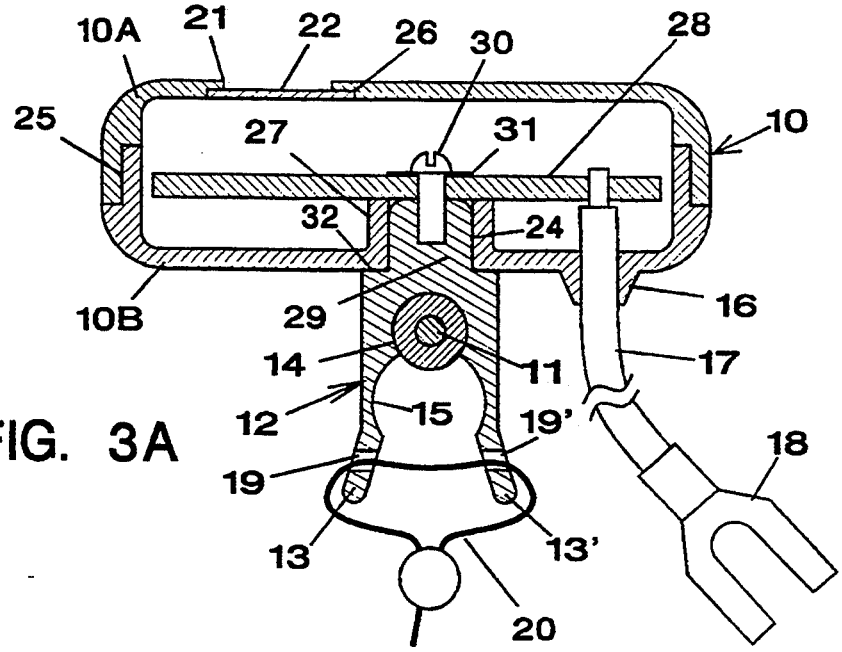
FIGS. 3A and 3B are side partial sectional views of the engine time log of Fig. 1, taken along line 3—3.
Figure 3B:
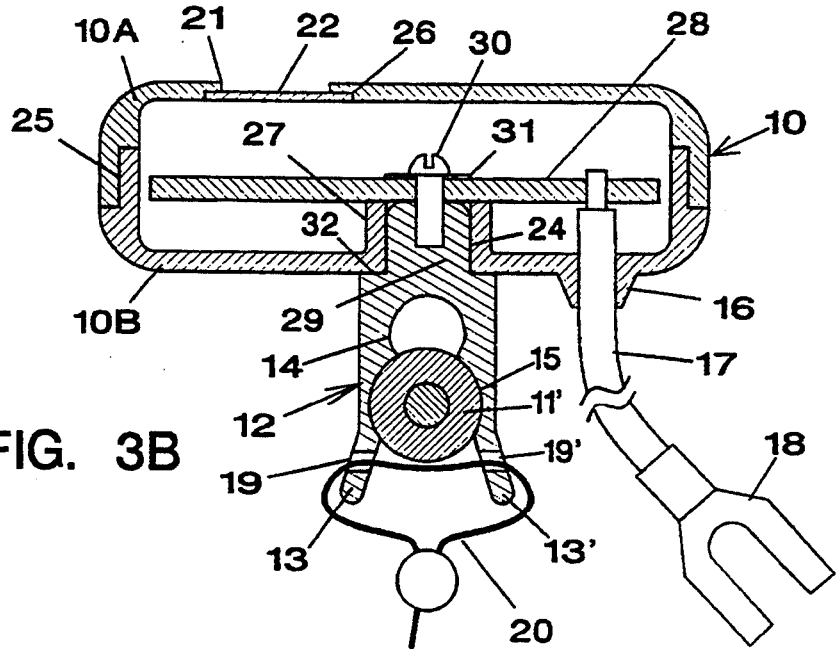
Figure 4:
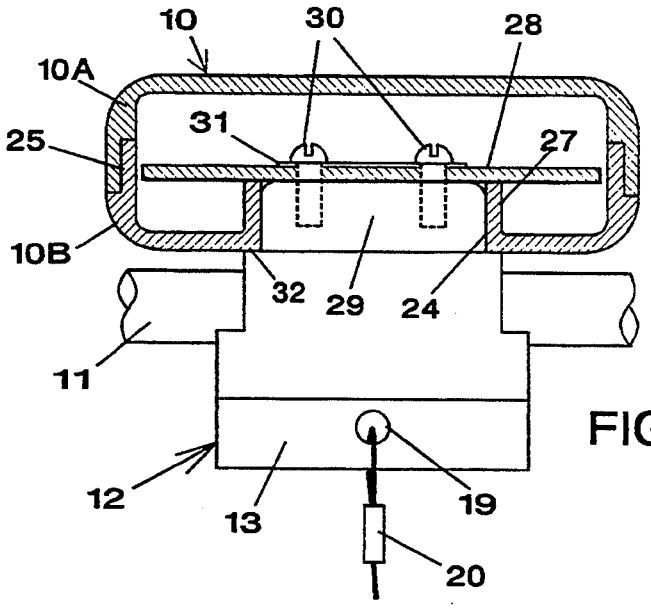
FIG. 4 is an end partial sectional view of the engine time log of Fig. 1, taken along line 4—4.
Figure 5:
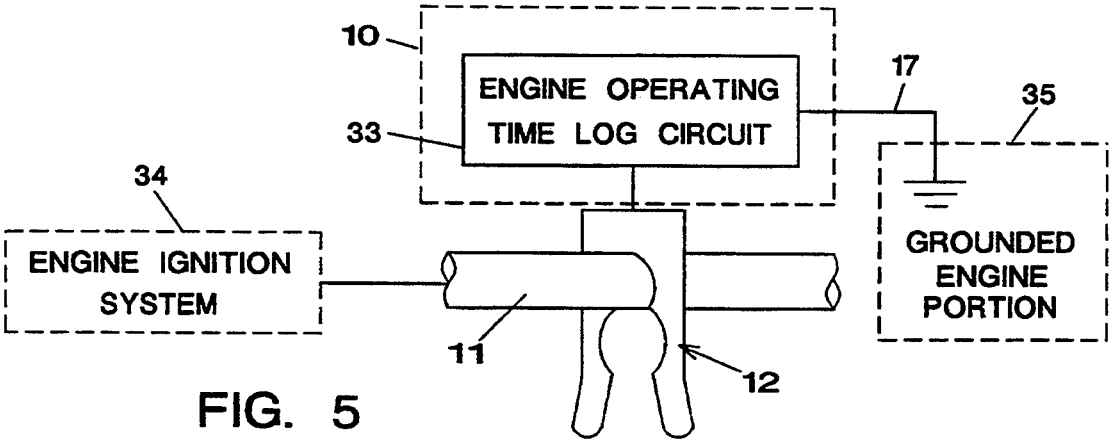
FIG. 5 is an electrical schematic diagram of the engine time log.

DESCRIPTION—FIGS. 3A and 3B

The engine time log is shown here in side partial sectional views taken along line 3—3 of FIG. 1. FIG. 3A shows the engine time log clipped onto a small ignition wire 11 with small channel 14, while FIG. 3B shows the engine time log clipped onto a larger ignition wire 11' with large channel 15.

The two halves 10A and 10B of plastic case 10 are welded together along an overlapping joint 25. Bezel 22 is mounted within window opening 21 with an overlapping joint 26. Sensor opening 24 on lower case halve 10B is located generally in the center of the case. A rectangular tube 27 attached to and concentric with sensor opening 24 extends inwardly to support a printed circuit board or PCB 28. A sensor shaft 29 slightly narrower than sensor 12 extends from the top of the sensor such that a square shoulder 32 is formed around the proximal end of the shaft. Shaft 29 is disposed within sensor opening 24 and tube 27 such that the top of the shaft contacts the lower side of PCB 28. Two metal screws 30 (one shown) structurally attach shaft 29 to PCB 28, while they also electrically connect sensor 12 to a conductive trace 31 on the circuitry (not shown) of PCB 28. As such, tube 27 and therefore case lower halve 10B are clamped between PCB 28 and shoulder 32 of sensor 12. Integral sensor 12 not only serves as a device for mounting the entire engine time log onto wire 11 or 11', it is also a solid state and therefore highly durable spark impulse sensor for the time log's sensing circuitry (not shown).

DESCRIPTION—FIG. 4

The engine time log is shown here in an end partial sectional view taken along line 4—4 of FIG. 1. Tube 27 surrounds sensor opening 24 to support PCB 28 as well as shaft 29 of sensor 12. Two screws 30 securely mount the PCB to the sensor.

DESCRIPTION—FIG. 5

A schematic of the engine time log is shown. Case 10 contains an engine operating time log circuitry 33 identical to the reference device's ("Background" section). Sensor 12 is structurally attached to case 10 and electrically attached to circuitry 33 to serve as the front end or the sensor of the circuit. The sensor is also attached to ignition wire 11 of an engine ignition system 34. Grounding wire 17 connects circuit 33 to a grounded portion 35 of the engine compartment.

When ignition system 34 is engaged such that spark impulses are sent through ignition wire 11, the engine time log will begin counting several seconds after sensor 12 and time log circuit 33 sense the presence of the impulses. Counting will automatically stop when the pulses cease. The elapsed time will be displayed on the LCD (not shown).

ADVANTAGES

Accordingly, the self-contained, clip-on engine operating time log has the following advantages:

A. It is entirely self-contained, self-powered, compact, and lightweight.

B. Installation is extremely easy: It can be easily and securely clipped directly onto any convenient ignition wire of an engine. The only other hookup is a single grounding wire, which can be attached to any convenient grounded portion of an engine compartment.

C. It will not void the warranty of commercial engines. Because it is simply clipped onto an ignition wire, it does not require the removal of an original engine bolt.

D. It can be clipped onto ignition wires of different sizes.

E. It can be used on spark ignition engines of any type, regardless of the number of cylinders, strokes, ignition system type, and including hand-start engines which lack battery power.

F. It requires no adjustments or setup.

G. It is highly accurate in monitoring the actual operating time of an engine.

H. It is heat, water, and solvent resistant, and is completely sealed to prevent liquid intrusion and tampering.

I. It will maintain its data even when disconnected from an engine.

J. It does not affect the operation of an engine.

K. It has an extremely long operating life.

While the above descriptions are specific, they should not be considered as limitations on the scope of the invention, but only as examples of the embodiments. Many other ramifications and variations are possible within the teachings of the invention. Thus, the reader is requested to determine the scope of the invention by the appended claims and their legal equivalents, and not by the examples given.

I claim:

1. An engine operating time log for mounting onto an ignition wire of an engine having an electrical system, comprising:

a case made of a heat resistant material, so that said case can be conveniently located adjacent said engine, said case having an opening, said opening having a concentric tube extending inwardly into said case, combination of sensing and mounting means extending rigidly from said case for mounting said case directly onto said ignition wire of said engine, said combination of sensing and mounting means being installable on said ignition wire by hand and without the need for tools, said combination member having an integral shaft extending into said opening of said case for rigidly mounting said combination member thereto, and circuit means disposed within said case for monitoring an accumulated operating time of said engine, said circuit means being electrically connected to said combination of sensing and mounting means for sensing an electrical current in said ignition wire said circuit means including an electronic digital display visible through said case for displaying said accumulated operating time.

2. The engine operating time log of claim 1 wherein said case is made of an electrically non-conductive material.

3. The engine operating time log of claim 1 wherein said combination of sensing and mounting means comprises a resilient clip having plural overlapping cylindrical channels of different diameters, whereby said clip can be clipped onto different ignition wires of different sizes.

4. The engine operating time log of claim 3, further including plural holes positioned through said clip near a distal end thereof for receiving a retaining wire therethrough, whereby said retaining wire prevents said clip from disengaging from said ignition wire.

5. The engine operating time log of claim 1, further including a grounding wire extending from said case for connecting to a grounded portion of said electrical system.

6. An engine operating time log for mounting onto an ignition wire of an engine having an electrical system, comprising:

a case made of a heat resistant material, so that said case can be conveniently located adjacent said engine said case having an opening, said opening having a concentric tube extending inwardly into said case, a sensor and mounting clip combination member extending rigidly from said case for clipping said case onto said ignition wire of said engine, said combination member having plural overlapping cylindrical channels of different diameters, said combination member being installable on said ignition wire by hand and without the need for tools, said combination member having an integral shaft extending into said opening of said case for rigidly mounting said combination member thereto, and circuit means disposed within said case for monitoring an accumulated operating time of said engine, said circuit means being electrically connected to said combination member for sensing an electrical current in said ignition wire said circuit means including an electronic digital display visible through said case for displaying said accumulated operating time.

7. The engine operating time log of claim 6 wherein said case is made of an electrically non-conductive material.

8. The engine operating time log of claim 6, further including plural holes positioned through said combination member near a distal end thereof for receiving a retaining wire therethrough, whereby said retaining wire prevents said combination member from disengaging from said ignition wire.

9. The engine operating time log of claim 6, further including a grounding wire extending from said case for connecting to a grounded portion of said electrical system.

10. An engine operating time log for mounting onto an ignition wire of an engine having an electrical system, comprising:

a case made of a heat resistant material, so that said case can be conveniently located adjacent said engine, said case having an opening, said opening having a concentric tube extending inwardly into said case, a sensor and mounting clip combination member for clipping onto said ignition wire of said engine, said combination member having plural overlapping cylindrical channels of different diameters, said combination member being installable on said ignition wire by hand and without the need for tools, said combination member having an integral shaft extending into said opening of said case for rigidly mounting said combination member thereto, said combination member having plural holes positioned through a distal end thereof for receiving a retaining wire therethrough, whereby said retaining wire prevents said combination member from disengaging from said ignition wire, and a circuit board disposed within said case, said circuit board being in structural engagement with said tube of said case and said shaft of said combination member, said circuit board being structurally and electrically attached to said shaft with an electrically conductive fastener, said circuit board having circuit means responsive to an electrical current in said ignition wire for monitoring an accumulated operating time of said engine said circuit means including an electronic digital display visible through said case for displaying said accumulated operating time.

11. The engine operating time log of claim 10 wherein said case is made of an electrically non-conductive material.

12. The engine operating time log of claim 10, further including a grounding wire extending from said case for connecting to a grounded portion of said electrical system.

13. An engine operating time log for mounting onto an ignition wire of an engine having an electrical system, comprising:

a case made of a heat resistant material, so that said case can be conveniently located adjacent said engine, said case having an opening, said opening having a concentric tube extending inwardly into said case, combination of sensing and mounting means extending rigidly from said case for mounting said case directly onto said ignition wire of said engine, said combination of sensing and mounting means being installable on said ignition wire by hand and without the need for tools, said combination member having an integral shaft extending into said opening of said case for rigidily mounting said combination member thereto, circuit means disposed within said case for monitoring an accumulated operating time of said engine, said circuit means being electrically connected to said combination of sensing and mounting means for sensing an electrical current in said ignition wire, and a grounding wire extending from said case for connecting to a grounded portion of said electrical system, said circuit means including an electronic digital display visible through said case for displaying said accumulated operating time.

14. The engine operating time log of claim 13 wherein said case is made of an electrically non-conductive material.

15. The engine operating time log of claim 13 wherein said combination of sensing and mounting means comprises a resilient clip having plural overlapping cylindrical channels of different diameters, whereby said clip can be clipped onto different ignition wires of different sizes.

16. The engine operating time log of claim 15, further including plural holes positioned through said clip near a distal end thereof for receiving a retaining wire therethrough, whereby said retaining wire prevents said clip from disengaging from said ignition wire.

* * * * *